US009496107B2

(12) United States Patent
Kim

(10) Patent No.: US 9,496,107 B2
(45) Date of Patent: Nov. 15, 2016

(54) SELF-BLAST CIRCUIT BREAKER REUSING ARC HEAT

(71) Applicant: HYUNDAI HEAVY INDUSTRIES CO., LTD, Ulsan (KR)

(72) Inventor: Hyung-Choon Kim, Ulsan (KR)

(73) Assignee: HYUNDAI HEAVY INDUSTRIES CO., LTD, Ulsan (KR)

( * ) Notice: Subject to any disclaimer, the term of this patent is extended or adjusted under 35 U.S.C. 154(b) by 0 days.

(21) Appl. No.: 14/577,508

(22) Filed: Dec. 19, 2014

(65) Prior Publication Data

US 2015/0294820 A1 Oct. 15, 2015

(30) Foreign Application Priority Data

Apr. 9, 2014 (KR) ..... 10-2014-0042575

(51) Int. Cl.
*H01H 33/90* (2006.01)
*H01H 33/72* (2006.01)
*H01H 33/88* (2006.01)

(52) U.S. Cl.
CPC ..... *H01H 33/90* (2013.01); *H01H 33/72* (2013.01); *H01H 2033/888* (2013.01); *H01H 2033/908* (2013.01)

(58) Field of Classification Search
CPC .. H01H 33/53; H01H 33/70; H01H 33/7084; H01H 33/7092; H01H 33/72; H01H 33/74; H01H 33/80; H01H 33/86; H01H 33/88; H01H 33/90; H01H 2033/902; H01H 2033/906; H01H 2033/908
USPC ..... 218/56, 57, 59, 61, 66, 116, 65, 97
See application file for complete search history.

(56) References Cited

U.S. PATENT DOCUMENTS 3,975,602 A * 8/1976 Hertz ..... H01H 33/901 218/66
4,598,188 A 7/1986 Schoetzau et al.
4,665,289 A * 5/1987 Yanabu ..... H01H 33/901 218/59
4,684,773 A 8/1987 Niemeyer
5,105,058 A * 4/1992 Perret ..... H01H 33/16 218/65
5,534,673 A * 7/1996 Lehmann ..... H01H 9/04 218/68
5,977,502 A * 11/1999 Mizoguchi ..... H01H 33/901 218/43
8,546,716 B2 * 10/2013 Nufer ..... H01H 33/901 218/43

(Continued)

FOREIGN PATENT DOCUMENTS

DE 19859764 A1 6/2000
JP 02247929 A 10/1990

(Continued)

OTHER PUBLICATIONS

European Search Report dated Sep. 15, 2015 in connection with the counterpart European Patent Application No. 15150352.1.

(Continued)

*Primary Examiner* — Renee Luebke
*Assistant Examiner* — William Bolton
(74) *Attorney, Agent, or Firm* — Hauptman Ham, LLP

(57) ABSTRACT

The present disclosure relates to a circuit breaker of a gas-insulated switchgear, and more particularly, to a self-blast circuit breaker of a gas-insulated switchgear, which reuses arc heat. A self-blast circuit breaker having a heat expansion chamber and a puffer chamber includes auxiliary intake valves which introduce a hot gas exhausted through an inside of an actuating rod, into the heat expansion chamber.

5 Claims, 15 Drawing Sheets

(56) References Cited

U.S. PATENT DOCUMENTS

| | | | | |
|---|---|---|---|---|
| 2008/0290069 | A1* | 11/2008 | Dufournet | H01H 33/901 218/59 |
| 2009/0090697 | A1* | 4/2009 | Dufournet | H01H 33/905 218/116 |
| 2010/0326958 | A1* | 12/2010 | Gregoire | H01H 33/905 218/46 |
| 2013/0168357 | A1* | 7/2013 | Yaginuma | H01H 33/08 218/57 |

FOREIGN PATENT DOCUMENTS

| | | | |
|---|---|---|---|
| JP | 3183120 | B2 | 7/2001 |
| JP | 2004119344 | A | 4/2004 |
| KR | 1020120002779 | A | 1/2012 |

OTHER PUBLICATIONS

Korean Office Action dated Oct. 23, 2015 in connection with the counterpart Korean Patent Application No. 10-2014-0042575.

* cited by examiner

SELF-BLAST CIRCUIT BREAKER REUSING ARC HEAT

CROSS REFERENCE TO RELATED APPLICATION

This application claims the benefit of Korean patent application No. 10-2014-0042575, filed on Apr. 9, 2014, entitled "Self-blast circuit breaker reusing arc heat", which is hereby incorporated by reference in its entirety into this application.

BACKGROUND

1. Technical Field

The present disclosure relates to a circuit breaker of a gas-insulated switchgear, and more particularly, to a self-blast circuit breaker of a gas-insulated switchgear, which reuses arc heat.

2. Related Art

A gas-insulated switchgear (GIS) refers to a switching system in which switching units such as a circuit breaker and a disconnecting switch, a transformer, a lightning arrestor, a main bus bar, and so on are collectively received in a metal tank, charging parts are supported by spacers, an SF6 gas as an insulation medium with excellent insulation and arc extinction performance is filled in the interior of the tank, and the tank is then sealed.

The main pressure-resistant components of the GIS include a gas circuit breaker, an earthing switch, a lightning arrestor, a potential transformer, a current transformer, and so forth.

The operating duties of the circuit breaker used in a GIS are specified in the IEC standard. In general, the rated operating sequence of 'O-0.3s-CO-3 min-CO' is observed.

Basically, in a circuit breaker, interrupting performance is required two times within 0.3 second. Since a first interruption duty is performed in the state in which the SF6 gas is in a cool gas state, the interrupting performance is excellent. Upon interruption, the temperature of the surrounding SF6 gas rises to 20,000° C. to 30,000° C. within a short time by a generated arc. A second interruption duty after 0.3 second is performed in the state in which the interior of the circuit breaker has a high temperature and a high pressure. Since the interrupting performance of the SF6 gas at the high temperature is abruptly degraded, it is difficult to interrupt fault current.

A related art is disclosed in Korean Unexamined Patent Publication No. 10-2012-0002779 (published on Jan. 9, 2012) entitled 'Self-blast interrupter of gas-insulated switchgear'.

SUMMARY

Various embodiments are directed to a self-blast circuit breaker which can continuously introduce the hot gas produced from the arc generated upon interruption, into a heat expansion chamber, and thereby, effectively raise the pressure of the heat expansion chamber.

Also, various embodiments are directed to improving the interrupting performance of a self-blast circuit breaker by raising the pressure of a heat expansion chamber through using arc heat.

In an embodiment, a self-blast circuit breaker having a heat expansion chamber and a puffer chamber may include: auxiliary intake valves which introduce a hot gas exhausted through an inside of an actuating rod, into the heat expansion chamber.

Each of the auxiliary intake valves may include a check valve in which an inlet is defined to communicate with the inside of the actuating rod and an outlet is defined to communicate with an inside of the heat expansion chamber.

The inlet may be defined in such a way as to be open toward an arc generation spot.

The actuating rod may include a rod part having the shape of a pipe; and a flange part having the shape of a flange which is coupled with the rod part.

The flange part may provide a mounting surface on which the auxiliary intake valves are mounted.

The mounting surface may have a regular polygonal sectional shape.

Each auxiliary intake valve may include a vale case in which a small diameter part having a relatively small inner diameter and a large diameter part having a relatively large inner diameter are formed to have an integral cylindrical shape, the inlet is defined in the small diameter part, and the outlet is defined in the large diameter part; and an opening/closing piece which closes the small diameter part by an elastic force of an elastic member disposed in the large diameter part, wherein the opening/closing piece is retracted by a pressure of the hot gas introduced through the inlet.

The auxiliary intake valves may be installed to allow the hot gas introduced therein to have a flow path of an obtuse angle.

According to the embodiments, advantages are provided in that, since the hot gas produced from the arc generated upon interruption is continuously introduced into a heat expansion chamber, the pressure of the heat expansion chamber may be effectively raised.

Also, according to the embodiments, advantages are provided in that the interrupting performance of a self-blast circuit breaker may be improved by raising the pressure of the heat expansion chamber through using arc heat.

DETAILED DESCRIPTION

Figure 1:
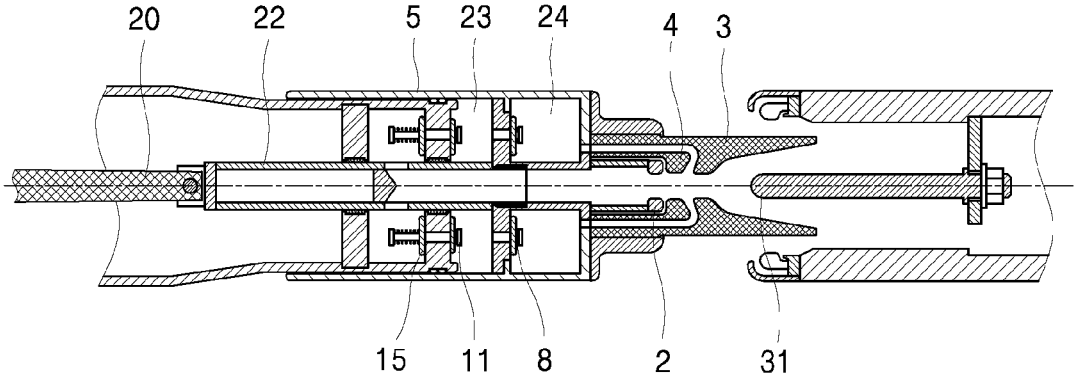
FIG. 1 is a cross-sectional view illustrating the structure of a conventional self-blast circuit breaker.

It is to be understood that the terms or words used in this description and the following claims must not be construed to have meanings which are general or can be found in a dictionary. Therefore, considering the notion that an inventor can most properly define the concepts of the terms or words to best explain his or her invention, the terms or words must be understood as having meanings or concepts that conform to the technical spirit of the present invention. Also, since the embodiments set forth herein and the configurations illustrated in the drawings are nothing but a mere example and are not representative of all technical spirits of the present invention, it is to be understood that various equivalents and modifications may replace the embodiments and configurations at the time of the present application.

Figure 2:
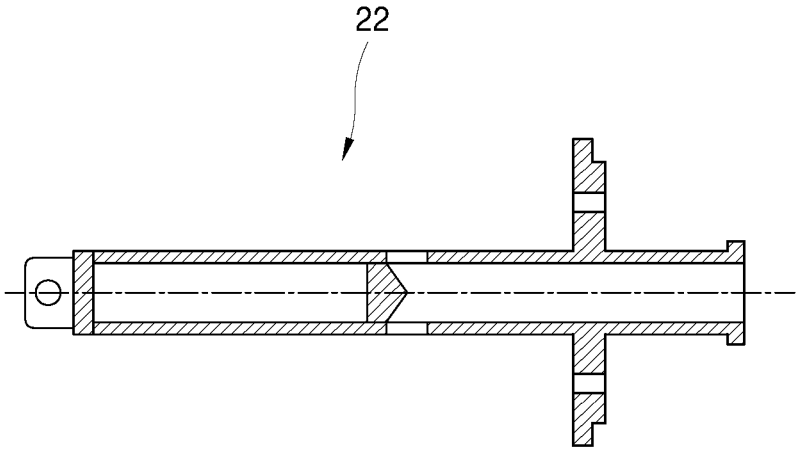
FIG. 2 is a cross-sectional view illustrating the actuating rod of the conventional self-blast circuit breaker.

FIG. 1 is a cross-sectional view illustrating the structure of a conventional self-blast circuit breaker, and FIG. 2 is a cross-sectional view illustrating the actuating rod of the conventional self-blast circuit breaker.

A self-blast circuit breaker as one kind of a circuit breaker of a gas-insulated switchgear (GIS) has a puffer chamber 23 and a heat expansion chamber 24, and generally includes three valves.

The three valves include an intake valve 11 for newly filling an SF6 gas in the puffer chamber 23 upon closing of the circuit breaker, an intake valve 8 for raising the pressure of the heat expansion chamber 24 upon opening of the circuit breaker, and an exhaust valve 15 for removing the unnecessary pressure of the puffer chamber 23.

When the circuit breaker interrupts current, movable parts such as an insulation rod 20, an actuating rod 22 and a puffer cylinder 5 are moved. At this time, as the volume of the puffer chamber 23 is decreased, an insulation gas in the puffer chamber 23 is compressed. If the pressure of the insulation gas reaches a predetermined pressure, the intake valve 8 is opened to raise the pressure of the heat expansion chamber 24.

The heat expansion chamber 24 becomes a high pressure as a high-temperature insulation gas by the arc generated upon interruption is introduced into the path between a main nozzle 3 and an auxiliary nozzle 4.

Due to this fact, as the heat expansion chamber 24 has a pressure higher than the puffer chamber 23, the intake valve 8 is closed. The movable parts of the circuit breaker are continuously moved, the volume of the puffer chamber 23 is further decreased, and the pressure of the puffer chamber 23 is further raised. Since the raised pressure cannot be introduced into the heat expansion chamber 24, it is exhausted through the exhaust valve 15.

The heat expansion chamber 24 discharges a high-pressure insulation gas at an interruption timing and cuts off an arc so as to implement interruption, by using the pressure initially introduced into the puffer chamber 23 and the pressure introduced from the high-temperature and high-pressure energy produced due to the arc generated as a fixed part arc contact 31 and a movable part arc contact 2 are physically separated from each other.

The interrupting performance of the self-blast circuit breaker is determined according the pressure and the temperature of the insulation gas in the heat expansion chamber 24. The pressure should be sufficient to cut off the arc column generated between the fixed part arc contact 31 and the movable part arc contact 2.

The insulation performance is excellent as the temperature of the insulation gas is low. Therefore, as the insulation gas has a low temperature and a high pressure, the interrupting performance becomes excellent.

The heat expansion chamber 24 should lower the temperature of the insulation gas by appropriately mixing the low-temperature insulation gas introduced from the puffer chamber 23 and the high-temperature insulation gas introduced between the main nozzle 3 and the auxiliary nozzle 4 due to the arc.

Figure 3:
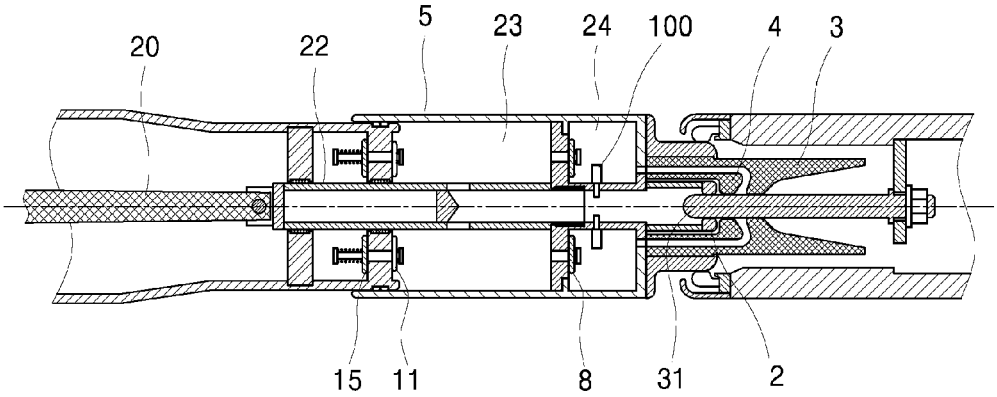
FIG. 3 is a cross-sectional view illustrating a self-blast circuit breaker reusing arc heat in accordance with an embodiment.

FIG. 3 is a cross-sectional view illustrating a self-blast circuit breaker reusing arc heat in accordance with an embodiment.

As shown in the drawing, the self-blast circuit breaker reusing arc heat in accordance with the embodiment has a feature in that it has auxiliary intake valves 100 which introduce the hot gas introduced into an actuating rod 22, into a heat expansion chamber 24.

Each of the auxiliary intake valves 100 may be formed as a check valve in which an inlet is defined to communicate with the inside of the actuating rod 22 and an outlet is defined to communicate with the inside of the heat expansion chamber 24.

The hot gas produced by an arc passes through the inside of the actuating rod 22. The auxiliary intake valves 100 are opened by such a hot gas, and introduce the hot gas produced by the arc, into the inside of the heat expansion chamber 24, thereby raising the pressure in the heat expansion chamber 24 and improving interrupting performance.

In order to enhance such effects, inlets may be defined to be open toward an arc generation spot.

Figure 4:
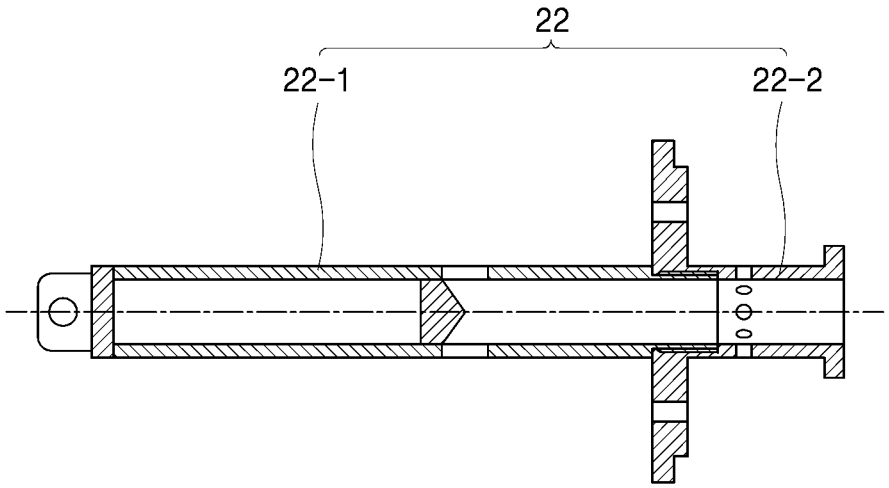
FIG. 4 is a cross-sectional view illustrating the actuating rod of the self-blast circuit breaker in accordance with the embodiment.
Figure 5A:
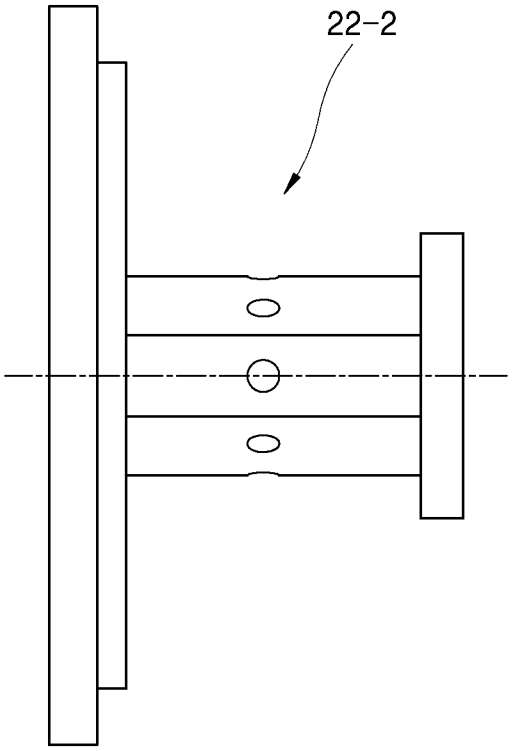
FIGS. 5*a* and 5*b* are views illustrating embodiments of the flange part of the actuating rod in accordance with the embodiment.
Figure 5B:
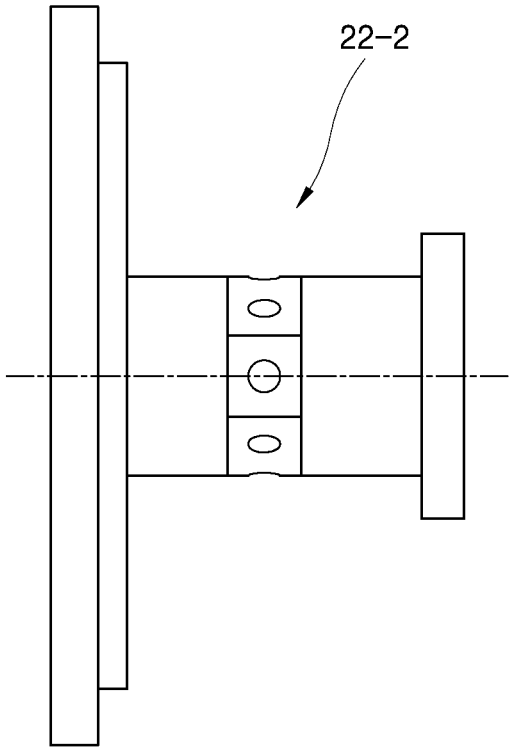

FIG. 4 is a cross-sectional view illustrating the actuating rod of the self-blast circuit breaker in accordance with the embodiment, and FIGS. 5*a* and 5*b* are views illustrating embodiments of the flange part of the actuating rod in accordance with the embodiment.

The auxiliary intake valves 100 are mounted to the actuating rod 22. In order to ensure easy mounting of the auxiliary intake valves 100, the actuating rod 22 may be formed in such a way as to be divided into a rod part 22-1 and a flange part 22-2.

FIG. 5*a* illustrates a state in which the pipe of the flange part 22-2 is formed to have a polygonal sectional shape, and FIG. 5*b* illustrates a state in which only the circumferential portion of the pipe of the flange part 22-2 to be mounted with the auxiliary intake valves 100 is formed to have a polygonal sectional shape.

Although the pipe of the flange part 22-2 may be formed to have a circular sectional shape, the mounting of the auxiliary intake valves 100 may be easily carried out when the mounting surfaces of the auxiliary intake valves 100 are formed as flat surfaces as shown in FIGS. 5*a* and 5*b*.

Figure 6A:
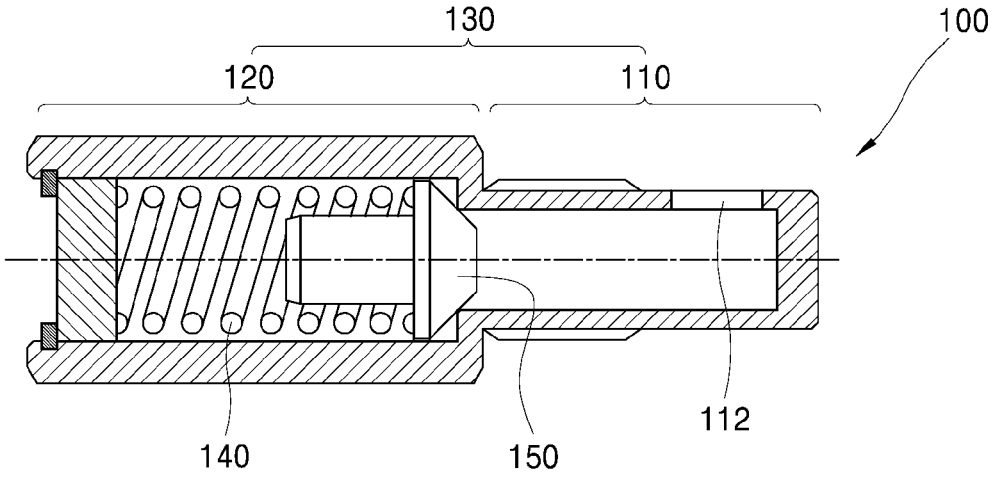
FIG. 6*a* is a cross-sectional view illustrating the closed state of an auxiliary intake valve in accordance with the embodiment.
Figure 6B:
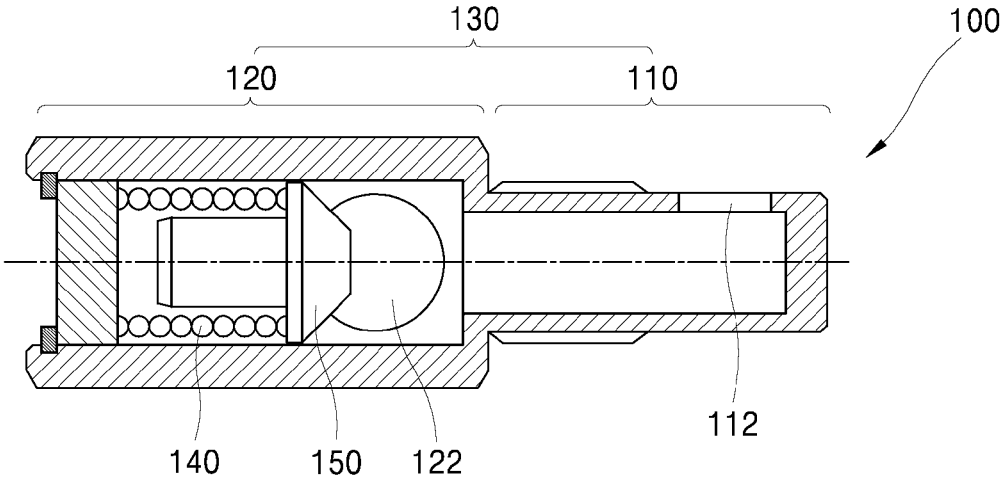
FIG. 6*b* is a cross-sectional view illustrating the opened state of the auxiliary intake valve in accordance with the embodiment.

FIG. 6*a* is a cross-sectional view illustrating the closed state of the auxiliary intake valve in accordance with the embodiment, and FIG. 6*b* is a cross-sectional view illustrating the opened state of the auxiliary intake valve in accordance with the embodiment.

The auxiliary intake valve 100 in accordance with the embodiment includes a valve case 130, and an opening/closing piece 150. In the valve case 130, a small diameter part 110, which has a relatively small inner diameter, and a large diameter part 120, which has a relatively large inner diameter, are formed to have an integral cylindrical shape. An inlet 112 is defined in the small diameter part 110, and an outlet 122 is defined in the large diameter part 120. The opening/closing piece 150 may close the small diameter part 110 by the elastic force of an elastic member 140 disposed in the large diameter part 120.

As shown in FIG. 6*b*, if the hot gas produced by the arc is introduced through the inlet 112, the opening/closing piece 150 is retracted and the elastic member 140 is compressed. Due to this fact, as the inlet 112 and the outlet 122 communicate with each other, the hot gas introduced through the inlet 112 may be introduced into the heat expansion chamber 24 through the outlet 122.

Figure 7A:
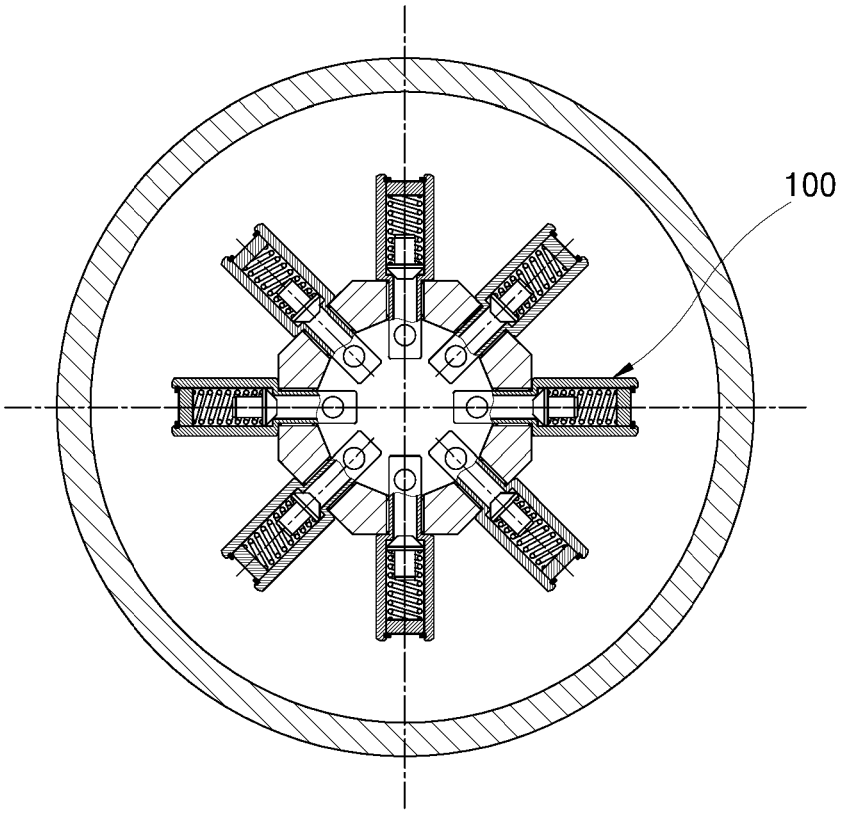
FIGS. 7*a* and 7*b* are cross-sectional views illustrating the assembled states of auxiliary intake valves in accordance with the embodiment.
Figure 7B:
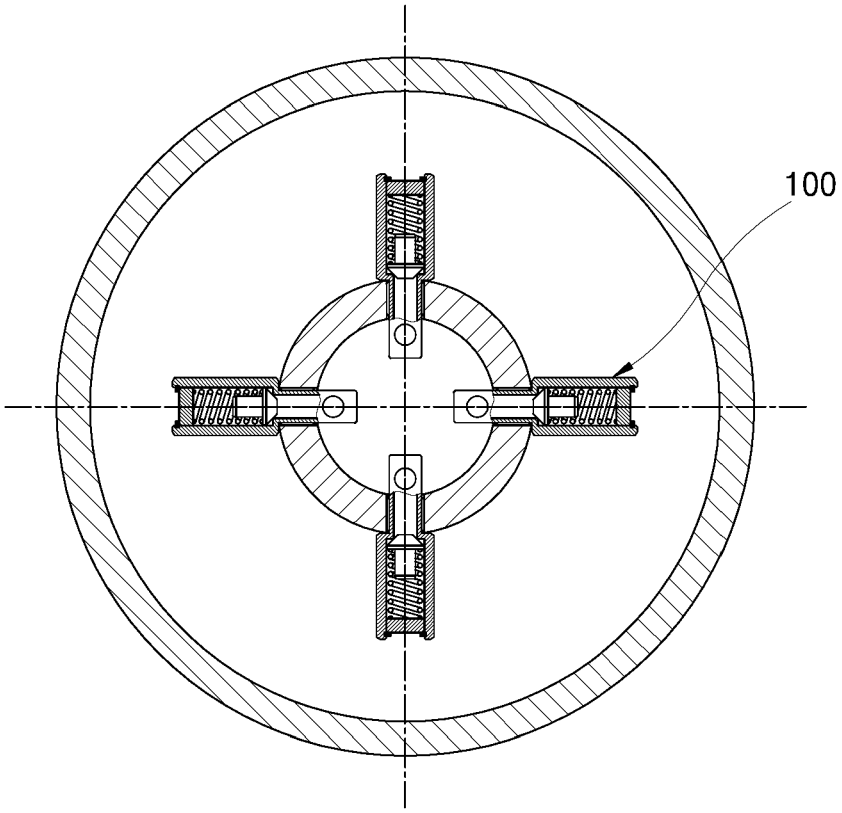

FIGS. 7*a* and 7*b* are cross-sectional views illustrating the assembled states of auxiliary intake valves in accordance with the embodiment.

As shown in FIG. 7*a*, the flange part may be formed into a regular octagonal shape, and eight auxiliary intake valves 100 may be mounted, and, as shown in FIG. 7*b*, the flange part may be formed into a cylindrical shape, and four auxiliary intake valves 100 may be mounted.

The sectional shape of the flange part or the number of the auxiliary intake valves 100 may be changed in a variety of ways.

FIGS. 8*a* to 8*e* are cross-sectional views explaining the operations of the self-blast circuit breaker in accordance with the embodiment.

Figure 8A:
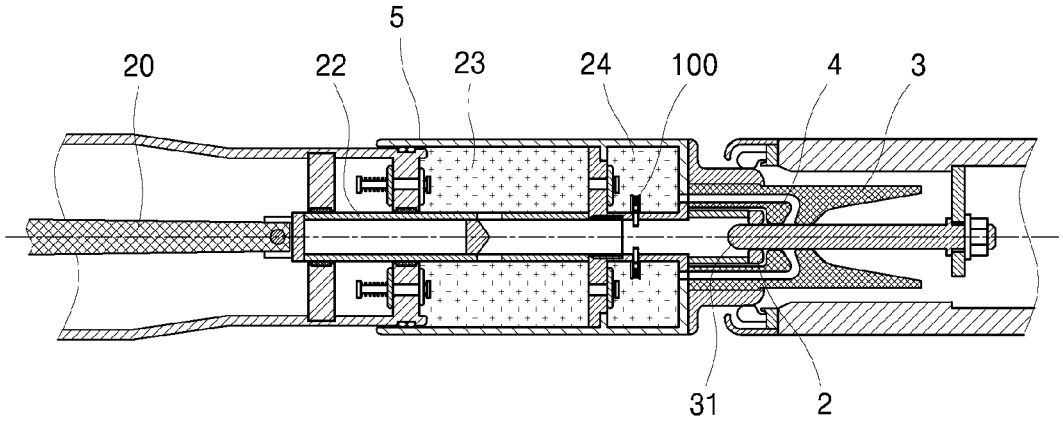
FIGS. 8*a* to 8*e* are cross-sectional views explaining the operations of the self-blast circuit breaker in accordance with the embodiment.
Figure 8B:
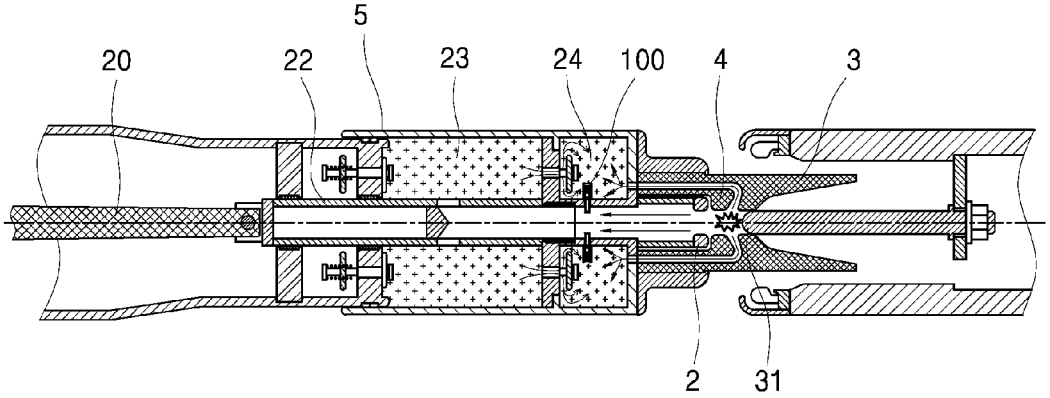

FIG. 8*a* illustrates a closed state. If opening is started from the closed state, as shown in FIG. 8*b*, after the fixed part arc contact 31 and the movable part arc contact 2 are disconnected from each other, compression of the puffer chamber 23 occurs, and the insulation gas is introduced into the heat expansion chamber 24.

Figure 8C:
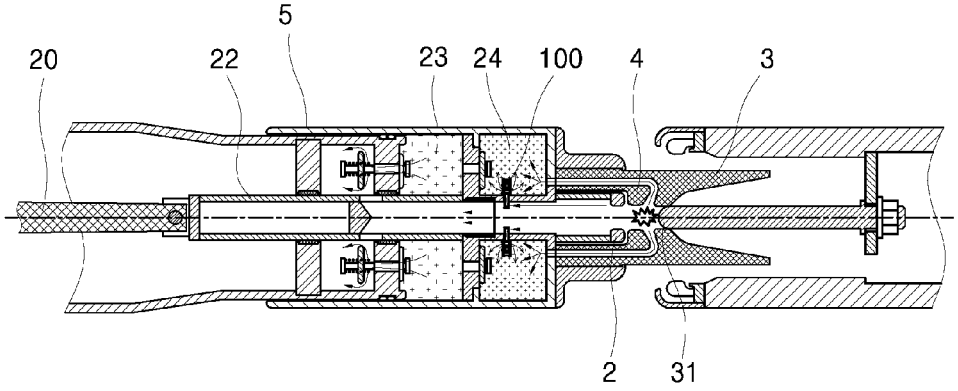

As the opening proceeds, as shown in FIG. 8*c*, the hot gas by the arc is introduced between the main nozzle 3 and the auxiliary nozzle 4, and the gas is exhausted from the puffer chamber 23.

Figure 8D:
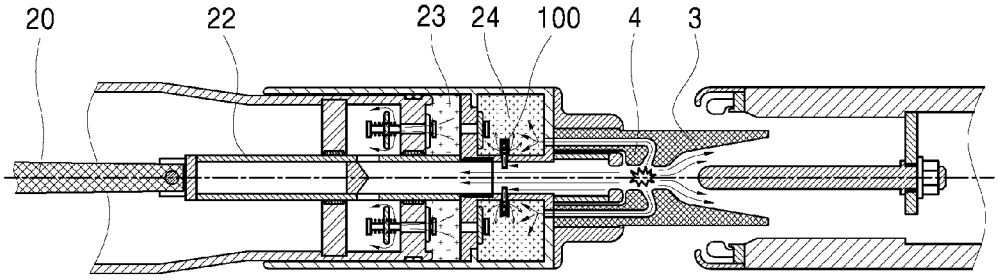

Next, as shown in FIG. 8*d*, the hot gas due to the arc, which is exhausted through the inside of the actuating rod 22, is introduced into the heat expansion chamber 24 through the auxiliary intake valves 100.

Figure 8E:
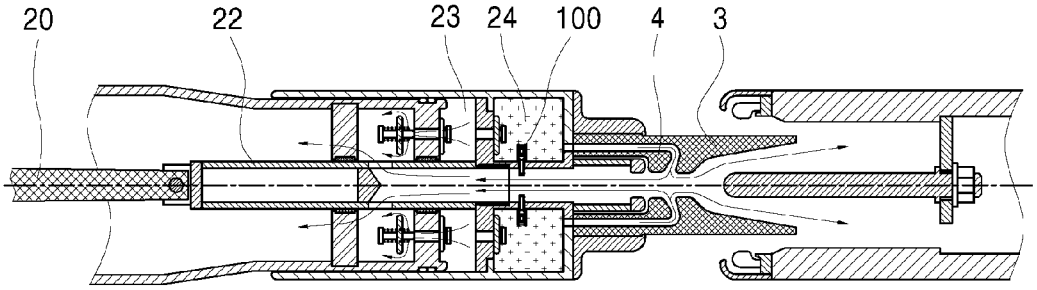

Then, as shown in FIG. 8*e*, the insulation gas of the heat expansion chamber 24 is exhausted through between the main nozzle 3 and the auxiliary nozzle 4, for interruption of current.

As is apparent from the above descriptions, the self-blast circuit breaker according to the embodiment provides advantages in that, since a portion of the hot gas discharged to an actuating rod, of a hot gas by a generated arc, is introduced into a heat expansion chamber, the pressure of the heat expansion chamber may be raised.

In consideration of the fact that a high-temperature and high-pressure hot gas due to an arc is partially introduced between a main nozzle and an auxiliary nozzle and most of the hot gas is exhausted through an actuating rod and a fixed part conductor, the embodiment has a feature in that auxiliary intake valves are provided in the actuating rod to introduce the high-pressure insulation gas to be exhausted, into the heat expansion chamber.

Hereinabove, although specific exemplary embodiments of the present invention have been described, various modifications may be made without departing from the scope of the present invention. Accordingly, the scope of the present invention is not construed as being limited to the described exemplary embodiments, but should be defined by the following claims as well as equivalents thereof.

Although the present invention has been described with reference to the exemplary embodiments and the accompanying drawings, it is not limited to the above-mentioned exemplary embodiments, but may be variously modified and altered from the above description by those skilled in the art to which the present invention pertains. Therefore, the scope and spirit of the present invention should be understood only by the following claims, and all of the equivalences and equivalent modifications of the claims should be intended to fall within the scope and spirit of the present invention.

What is claimed is:

1. A self-blast circuit breaker having a heat expansion chamber and a puffer chamber, comprising:

auxiliary intake valves which introduce a hot gas exhausted through an inside of an actuating rod, into the heat expansion chamber, wherein the auxiliary intake valves are mounted on the actuating rod, wherein the actuating rod comprises:

a rod part having the shape of a pipe; and a flange part having the shape of a flange which is coupled with the rod part, wherein the flange part provides a mounting surface on which the auxiliary intake valves are mounted, and wherein the mounting surface has a regular polygonal sectional shape.

2. The self-blast circuit breaker according to claim 1, wherein each of the auxiliary intake valves comprises a check valve in which an inlet is defined to communicate with the inside of the actuating rod and an outlet is defined to communicate with an inside of the heat expansion chamber.

3. The self-blast circuit breaker according to claim 2, wherein the inlet of at least one of the auxiliary intake valves is arranged facing an arc generation contact.

4. A self-blast circuit breaker having a heat expansion chamber and a puffer chamber, comprising:

auxiliary intake valves which introduce a hot gas exhausted through an inside of an actuating rod, into the heat expansion chamber, wherein the auxiliary intake valves are mounted on the actuating rod, and wherein each auxiliary intake valve comprises:

a valve case in which a small diameter part having a relatively small inner diameter and a large diameter part having a relatively large inner diameter are formed to have an integral cylindrical shape, the inlet is defined in the small diameter part, and the outlet is defined in the large diameter part; and an opening/closing piece which closes the small diameter part by an elastic force of an elastic member disposed in the large diameter part, wherein the opening/closing piece is retracted by a pressure of the hot gas introduced through the inlet.

5. The self-blast circuit breaker according to claim 4, wherein the auxiliary intake valves are installed to allow the hot gas introduced therein to have a flow path of an obtuse angle.

* * * * *